US005201600A

United States Patent [19]

Topf, Jr. et al.

[11] Patent Number: 5,201,600

[45] Date of Patent: Apr. 13, 1993

[54] MANHOLE SEALING APPARATUS AND METHOD

[75] Inventors: Henry E. Topf, Jr., Roachdale; Gregg A. Gillentine, Greenwood, both of Ind.

[73] Assignee: Miller Pipeline Corporation, Indianapolis, Ind.

[21] Appl. No.: 766,626

[22] Filed: Sep. 26, 1991

[51] Int. Cl.[5] ..... E02D 29/14

[52] U.S. Cl. ..... 404/25; 52/20; 156/292; 156/295

[58] Field of Search ..... 404/25, 26; 52/20; 277/207 A, 207 R; 156/292, 295, 304.2

[56] References Cited

U.S. PATENT DOCUMENTS

| | | | |
|---|---|---|---|
| 1,940,924 | 12/1933 | Taylor | 404/25 X |
| 2,930,295 | 3/1960 | Hale | 94/34 |
| 3,248,119 | 4/1966 | Smith et al. | 277/22 |
| 3,621,623 | 11/1971 | Downes | 52/20 |
| 3,920,347 | 11/1975 | Sauriol et al. | 404/25 |
| 4,187,647 | 2/1980 | Hall | 52/20 |
| 4,188,151 | 2/1980 | Hall | 404/26 |
| 4,469,467 | 9/1984 | Odill et al. | 404/25 |
| 4,540,310 | 9/1985 | Ditcher et al. | 404/25 |
| 4,557,625 | 12/1985 | Jahnke et al. | 404/25 |
| 4,725,324 | 2/1988 | Schmidt | 156/304.2 X |
| 4,759,656 | 7/1988 | Wilson | 404/26 |
| 4,772,154 | 9/1988 | Caroulle | 404/25 |
| 4,927,163 | 5/1990 | Gagas | 277/23 |
| 5,094,795 | 3/1992 | McMillan et al. | 156/304.2 X |

*Primary Examiner*—William P. Neuder
*Attorney, Agent, or Firm*—Barnes & Thornburg

[57] ABSTRACT

An apparatus and method is provided for providing a mold that can be filled with sealing material to establish a barrier seal on top of a manhole to block unwanted inflow of groundwater into the manhole through a space or gap between either the manhole and manhole frame or a pair of adjacent manhole sections. The apparatus includes a pair of circular channel rings that can be mounted on the top face of the manhole. The channel rings are arranged to form an annular sealing material-retaining channel therebetween. The channel rings are strong enough to support a heavy manhole frame (or another manhole section) above the manhole and in contact with the sealing material in the annular channel. The sealing material cures to establish a water-tight pliable seal bonding the manhole frame (or other manhole section) to the manhole.

53 Claims, 1 Drawing Sheet

MANHOLE SEALING APPARATUS AND METHOD

BACKGROUND AND SUMMARY OF THE INVENTION

This invention relates to manhole sealing systems and, in particular, to an apparatus and method for molding a sealing material to establish a fluid-tight seal and bond either between a manhole and a manhole frame supported on the manhole (or between two sections of a manhole). More particularly, this invention relates to an apparatus and method for providing a mold that can be filled with sealing material to establish a barrier seal on top of a manhole to block unwanted inflow of groundwater into the manhole through a space between the manhole and manhole frame (or between two sections of a manhole).

A manhole is a large diameter vertical pipe often made of brick or a series of precast concrete sections that extends downward from a point just below street level to a buried sewer pipe included in a municipal sewerage system. Typically, a heavy cast iron manhole frame is placed on the circular top edge of the manhole to hold a manhole cover above the top end of the manhole at street level. While the manhole cover is visible to someone standing on the street, the manhole frame supporting the cover usually is hidden mostly from view by the surrounding street or sidewalk as long as the manhole cover is in place to block access into the manhole.

In some cases, the street or sidewalk pavement around the manhole frame acts to hold the manhole frame in place on the manhole. It is also known to use bolts or other hardware to anchor the manhole frame to the underlying manhole. The familiar manhole cover rests on a circular ledge provided near the top end of the manhole frame to lie at street level. Removal of the manhole cover from the frame exposes a vertical access aperture that extends downwardly through the hollow manhole frame to enable service workers to pass through the manhole frame to reach the downwardly extending manway passage provided inside the manhole.

Unwanted leakage or "inflow" of fluids such as rainwater or groundwater into a manhole connected to a sewage disposal sewer system is a serious problem. The typical sewage treatment plant provided to process sewage conducted through a sewage disposal system is designed to handle sewage only and is not designed to have enough capacity to handle large volumes of surface water that leak into the sewage disposal sewers through leaky manholes. Typically, each municipality will include two separate sewerage systems. One system of sewers is provided to carry off sewage and other refuse liquids and waste products to a sewage treatment plant. The other system is often referred to as the "storm sewer" system and is connected to street drains and the like to carry off surface water.

A small or large gap between the top face of the manhole and the bottom face of the manhole frame (or at the joint between two abutting manhole sections) can provide just enough space for significant amounts of rainwater, groundwater, or other liquids to leak from the surrounding ground into the manhole and the sewage disposal sewer pipes connected to the manhole. Manhole leakage problems can cause too much surface water or other fluids to be introduced into the sewage disposal sewer system at one time and therefore overload the capacity of various sewage treatment stations included in the sewerage system. The capacity of a sewerage system having a sizable number of leaky manhole frames can be overloaded quite easily during prolonged and heavy rainstorms.

A gap between a manhole frame and an underlying manhole large enough to permit surface water to leak into a manhole can develop in several different ways. Manhole frames tend to vibrate due to loads applied by traffic moving on the street and over the manhole cover and, over time, such vibration can cause even heavy manhole frame to move off the underlying manhole to form a gap therebetween. Such movement can occur even though the manhole frame is initially anchored in some way to the manhole. Also, any seal established between the manhole and manhole frame can deteriorate or fail over time and cause a leakage gap to develop.

A leakage gap can also develop at the joint between two abutting manhole cylinders. Manholes are typically formed by connecting precast concrete cylinders together in series to establish a long manhole unit. Water inflow problems can also arise if any leakage occurs at the joint between a pair of adjoining cylinders. Poor anchoring and sealing connection problems are not limited only to manhole frame/manhole connections. It is also common for leaks to develop because one manhole cylinder has moved relative to an adjoining manhole cylinder or because a seal provided between the two cylinders has failed.

An apparatus and method for molding a sealing material to establish a fluid-tight sealing bond closing any gap between an inground manhole and a manhole frame without removing the manhole frame from its mounted position on the manhole would simplify rehabilitation of leaky manholes. An apparatus and method that could also be used to fill and close any gap at the joint between abutting manhole cylinder portions would also provide many benefits to manhole installation and rehabilitation work crews. Also, an apparatus and method that could be applied to solve fluid inflow problems affecting a great number of manholes in a sewerage network quickly, at low cost, and without making it necessary for service workers to carry a lot of extra tools would be welcomed by many managers of city and metropolitan sewerage systems.

According to the present invention, an innovative method is provided for providing a sealed bond between a manhole having an annular top face and a manhole frame configured to mount on the annular top face of the manhole. The method can also be used to provide a sealed bond between two adjacent manhole sections. The method includes the steps of establishing an annular channel on the annular top face of the manhole and filling the annular channel with a liquid sealing material. The method further includes the steps of putting the manhole frame (or other manhole section) over the annular top face of the manhole and in contact with the liquid sealing material in the channel and then curing the liquid sealing material. Once cured, the liquid sealing material bonds the manhole to the manhole frame (or other manhole section) and establishes a fluid-tight seal therebetween to block inflow of fluid into the manhole through a space between the manhole and the manhole frame (or other manhole section).

In preferred embodiments, the annular channel is established on top of the manhole by placing an inside channel ring on the annular top face of the manhole adjacent to an interior side wall of the manhole and placing an outside channel ring on the annular top face of the manhole adjacent to the exterior side wall of the manhole. The inner diameter of the outside channel ring is greater than the inner diameter of the inside channel ring so that the two channel rings can be arranged on top of the manhole to establish the annular channel therebetween. It is preferable to use an adhesive material to hold the inside and outside channel rings in place on the annular top face of the manhole during the filling, putting, and curing steps.

It is desirable to prepare the surface of the annular top face of the manhole prior to placing the inside and outside channel rings thereon to promote bonding of the manhole to the liquid sealing material contained in the annular channel upon curing of the liquid sealing material. Likewise, it is desirable to prepare the surface of the annular bottom face of the manhole frame (or other manhole section) prior to placing the manhole frame on top of the channel rings to promote bonding of the manhole frame to the liquid sealing material contained in the annular channel upon curing of the liquid sealing material. The liquid sealing material is preferably either polyurethane encapsulate (such as ENCAPSEAL), epoxy, or fiberglass that is formulated to cure after a predetermined period of time to establish a water-tight pliable seal blocking inflow of water into the manhole through the space between the manhole and the manhole frame (or other manhole section) and bonding the manhole to the manhole frame (or other manhole section).

Advantageously, the method in accordance with the present invention can be used to bond a manhole frame (or other manhole section) to a manhole in such a way as to block inflow or leakage of fluid into the manhole. A novel manhole seal molding kit is provided to enable workers to practice the inventive method in the field easily and at low cost. The kit has component parts such as the inside and outside channel rings which are capable of being assembled in the field at a manhole to provide a mold for containing a liquid sealing and bonding material in a walled reservoir in contact with a manhole frame (or other manhole section) and an underlying manhole.

Once the two channel rings are properly positioned and retained on the manhole, liquid sealing material can be deposited in the annular channel formed by the coaxially aligned channel rings. The heavy manhole frame (or other manhole section) can then be lowered onto the top portion of the channel rings to lie in contact with the pool of liquid sealing material retained in the annular channel. Once the sealing material hardens or cures in the annular channel mold, a fluid-tight seal is established to block or plug any gap between the manhole frame (or other manhole section) and the manhole, and the manhole frame (or other manhole section) is bonded to the manhole to anchor the manhole frame (or other manhole section).

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
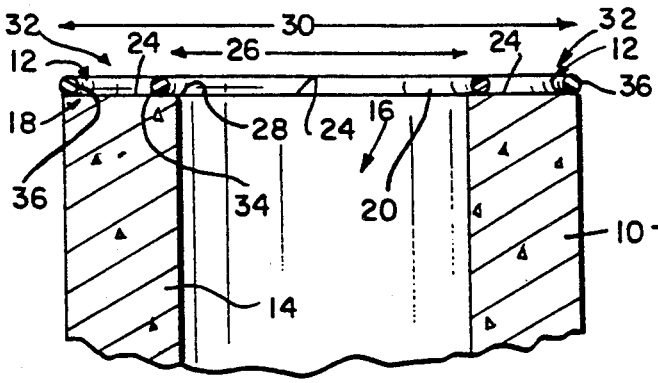
FIG. 1 is an elevation of a manhole showing an inside channel ring and an outside channel ring in place on the top face of the manhole in accordance with the present invention.

The top portion of a manhole 10 is illustrated in FIG. 1. Typically, a manhole is a cylindrical structure made of brick or a series of precast concrete sections that is provided to permit a worker to gain access to a subterranean sewerage system (not shown) connected to the bottom of the manhole. Manhole 10 includes a ring-shaped top face 12 and a cylindrical interior side wall 14 defining an internal manway passage 16.

Initially, the ring-shaped top face 12 is prepared to promote bonding of a sealing material to be placed in contact with the top face 12. For example, the face 12 can be cleaned and treated by sandblasting, wire brushing, scaling, or knocking. It is also possible to use a pneumatic tool to vibrate and hit the top face 12 of the manhole 10 to ready the top face 12 to receive a primer such as methel ethel ketone. Once primed, the top face 12 is prepared to receive a mold apparatus 18 and to be contacted by a liquid sealing material 38.

A mold apparatus 18 is positioned on top face 12 to form a mold cavity 32 on top of the manhole 10. Mold apparatus 18 can be provided using a field kit including an inside channel ring 20 and an outside channel ring 22. Preferably, an adhesive material 24 is used to hold the inside and outside channel rings 20, 22 in place on the top face 12 of the manhole 10 as shown in FIG. 1. For example, contact cement, available from Bitumastic, is a suitable adhesive for this purpose.

Inside channel ring 20 has an inner diameter 26 and is configured to fit on the top face 12 of manhole 10 to lie in close proximity to the top edge 28 of the cylindrical interior side wall 14 as shown in FIG. 1. Outside channel ring 22 has an inner diameter 30 that is greater than the inner diameter 26 of the inside channel ring 20.

When arranged on the top face 12 as shown in FIG. 1, the inside and outside channel rings 20, 22 are positioned in coaxial alignment and spaced-apart relation to form a circular channel or mold cavity 32 therebetween. A radially inner boundary of the circular channel 32 is established by a radially outwardly facing side 34 of the inside channel ring 20. A radially outer boundary of the circular channel is established by a radially inwardly facing side 36 of the outside channel ring 22.

Figure 2:
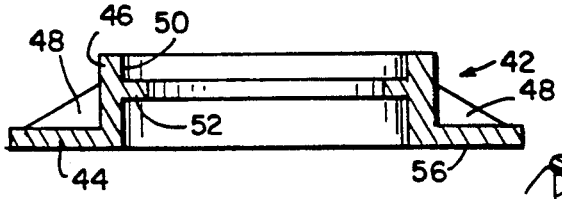
FIG. 2 is a view of the manhole of FIG. 1 during filling of an annular channel formed between the inside and outside channel rings with a liquid sealing material and of a manhole frame configured to mount on the manhole and support a manhole cover at street level.
Figure 2:
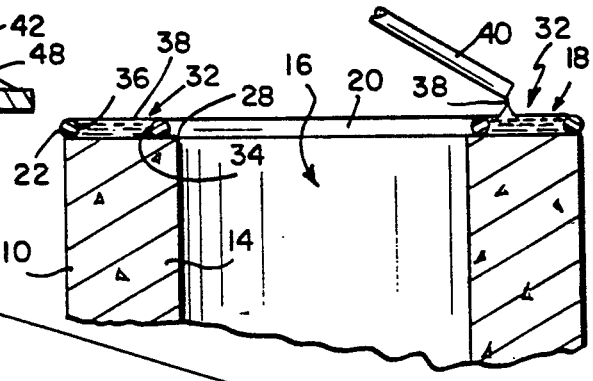

The inside and outside channel rings 20, 22 thus cooperate with the top face 12 of the manhole to form a circular channel 32 that serves as a mold for containing a liquid sealing and bonding material 38 as shown in FIG. 2. A sealant dispensing tube 40 is used to dispense liquid sealing bonding material 38 into the circular channel 32. Suitable sealing and bonding materials include ENCAPSEAL polyurethane, available from Miller Pipeline Corporation; fiberglass, available from DuPont Chemicals; and a variety of well-known epoxies and polyurethanes. These materials are formulated to cure after a predetermined period of time.

Figure 3:
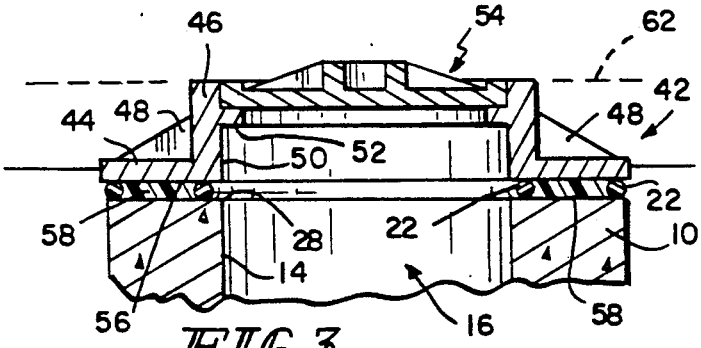
FIG. 3 is an elevation of the manhole of FIGS. 1 and 2 showing the manhole frame in its mounted position after the liquid sealing material has cured to form a pliable seal and bond the manhole frame to the manhole.

A manhole frame 42 is shown in FIG. 2 and sized to mount on top of the channel rings 20, 22 placed on the top face 12 of manhole 10. Manhole frames 42 are well-known structures that are usually made of cast iron and configured to support a round manhole cover. Manhole frame 42 includes a circular, ring-shaped base 44, an upright cylindrical member 46, and a plurality of circumferentially spaced-apart vertical support webs 48 stiffening the upright orientation of cylindrical member 46. The cylindrical member 46 includes an annular interior side wall 50 and a radially inwardly extending annular ledge 52 forming a seat for supporting a round manhole cover 54 thereon as shown best in FIG. 3. The annular ledge 52 is formed to include a central opening 56 providing an access aperture to permit a worker to gain entry into the manway passage 16 of the manhole 10 once the manhole cover 54 is removed.

After the liquid sealing and bonding material 38 is poured into the mold cavity provided by circular channel 32 and before that material 38 sets up, a manhole frame such as frame 42 is set down onto the top surfaces of the inside and outside channel rings 20, 22 so that substantially the entire underside 56 of the ring-shaped base 44 that lies in the space between rings 20, 22 contacts the liquid sealing and bonding material 38. Preferably, the channel rings 20, 22 are made of a sturdy rubber or structural foam such as closed-cell polyurethane foam so that the rings 20, 22 can support the weight of the manhole frame 42 and hold the manhole frame 42 in vertically spaced-apart relation to the top face 12 of manhole 10 while the sealing and bonding material 38 cures. The channel rings 20, 22 are impermeable to the extent necessary to cause the liquid sealing and bonding material 38 to be retained in the annular channel 32 until the material 38 cures.

In one embodiment, the liquid sealing and bonding material 38 is allowed to "set up" enough so that it alone can support the weight of the manhole frame 42 (or a manhole section as shown in FIG. 8) without relying on support provided by the channel rings 20, 22. Using this technique, the sealing and bonding material is allowed to catalyze enough to support a manhole frame 42 but not enough to disallow a bond between the manhole frame 42 and the manhole 10. The ambient temperature on the day the liquid sealing and bonding material 38 is poured into annular channel 32 is one important factor affecting how fast the material 38 catalyzes.

Essentially, the sealing and bonding material 38 is formulated to cure after a predetermined time to establish a water-tight pliable annular seal 58 shown bonding the manhole frame 42 to the manhole 10. Preferably, the underside 56 of the ring-shaped base 44 is prepared using one or more of the above-described preparation techniques to enhance bonding of the liquid sealing and bonding material 38 to the manhole frame 42 as it cures to form the pliable annular seal 58. Once the seal 58 is established, then the pavement 62 for a street or sidewalk can be laid in the conventional way around the manhole frame 42. The bond between manhole frame 42 and manhole 10 established by seal 58 anchors manhole frame 42 to manhole 10 to minimize any disruptive movement or shifting of manhole frame 42 relative to manhole 10 that might otherwise lead to the formation of a leakage gap at the joint between the manhole frame and manhole.

Figure 4:
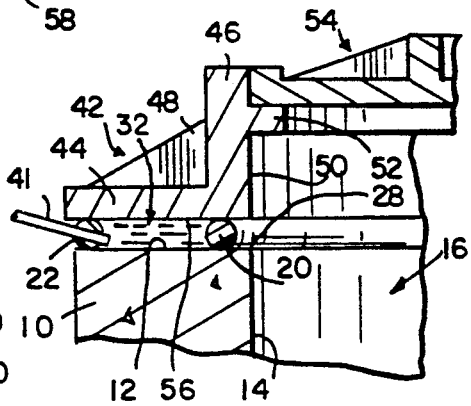
FIG. 4 is an enlarged view showing use of an air vent tube to discharge air from a ring-shaped mold cavity defined by the manhole, inside and outside channel rings, and manhole frame.

A technique for venting air from annular channel 32 as it is filled with liquid sealing and bonding material 38 is illustrated in FIG. 4. Using this technique, the manhole frame 42 is placed on top of the two channel rings 20, 22 after the annular channel 32 is filled. An air-venting tube 41 is used to vent air from the ring-shaped closed mold cavity 32 bounded by the radially outwardly facing side 34 of inner channel ring 20, the top face 12 of manhole 10, the radially inwardly facing side 36 of outer channel ring 22, and the underside 56 of manhole frame 42. The tube 41 could be in place as shown in FIG. 4 before the manhole frame 42 is lowered onto the channel rings 20, 22 or the tube 40 could be inserted into the annular channel 32 through an aperture (not shown) provided in either the inside or outside channel ring 20, 22.

Figure 5:
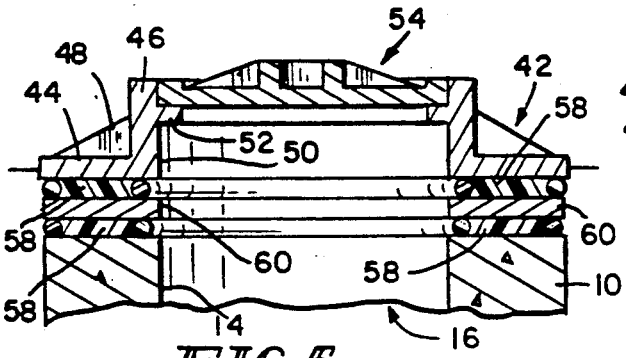
FIG. 5 is a view of a manhole wherein a grade ring is used to elevate the manhole frame relative to the manhole and a pair of inside channel rings and a pair of outside channel rings are used to establish one annular mold cavity channel above the grade ring and another annular mold cavity channel below the grade ring.

The use of a grade ring 60 to elevate the manhole frame 42 relative to the manhole 10 is shown in FIG. 5. In this embodiment, a first seal bonding the manhole 10 to the bottom side of grade ring 60 can be created using a field mold kit including a first set of inside and outside channel rings 20, 22 and a second seal bonding the top side of trade ring 60 can be created using a second set of inside and outside channel rings 20, 22. Thus, the apparatus and method of the present invention is well suited for bonding grade rings or the like to manholes and manhole frames and sealing spaces or gaps between grade rings or the like to manholes and manhole frames.

Figure 6:
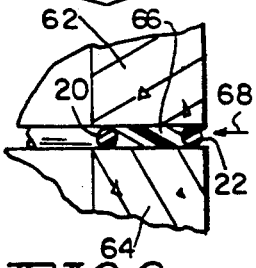
FIG. 6 is a sectional view of two adjacent manhole cylinder sections and a pair of inside and outside channel rings positioned therebetween to mold a pliable seal bonding and sealing the upper manhole cylinder section to the lower manhole section.

Referring to FIG. 6, a first manhole cylinder section 62 is arranged to be mounted on top of a second manhole cylinder section 64. Inside and outside channel rings 20, 22 are used to form an annular mold cavity 32 for retaining a liquid sealing and bonding material therein which cures to form a pliable seal 64. Seal 64 closes any water leakage gap at the joint 68 between the manhole cylinder sections 62, 64 and bonds the first and second manhole sections 62, 64 together.

Although the invention has been described and defined in detail with reference to certain preferred embodiments, variations and modifications exist within the scope and spirit of the invention as described and defined in the following claims.

What is claimed is:

1. A method of providing a sealed bond between a manhole having an annular top face and a manhole frame configured to mount on the annular top face, the method comprising the steps of establishing an annular channel on the annular top face of the manhole, filling the annular channel with a liquid sealing material, then putting the manhole frame over the annular top face of the manhole in contact with the liquid sealing material in the channel, and curing the liquid sealing material to bond the manhole to the manhole frame and establish a fluid-tight seal therebetween to block inflow of fluid into the manhole through a space between the manhole and the manhole frame.

2. The method of claim 1, wherein the manhole frame includes an annular bottom face and further comprising the step of preparing the annular bottom face of the manhole frame prior to the putting step to promote bonding of the manhole frame to the liquid sealing material upon curing of the liquid sealing material.

3. The method of claim 2, wherein the preparing step includes the step of applying a primer to the bottom annular face.

4. The method of claim 2, wherein the preparing step includes the step of scaling the bottom annular face.

5. The method of claim 1, wherein the liquid sealing material is one of a polyurethane encapsulate, epoxy, and fiberglass that is formulated to cure after a predetermined period of time to establish a water-tight pliable seal bonding the manhole to the manhole frame.

6. The method of claim 1, wherein the curing step includes the step of delaying the putting step for a predetermined period of time to allow the liquid sealing and bonding material to provide means for supporting the weight of the manhole frame in spaced relation to the manhole.

7. A method of providing a sealed bond between a manhole having an annular top face and a manhole frame configured to mount on the annular top face, the method comprising the steps of establishing an annular channel on the annular top face of the manhole, filling the annular channel with a liquid sealing material, putting the manhole frame over the annular top face of the manhole in contact with the liquid sealing material in the channel, and curing the liquid sealing material to bond the manhole to the manhole frame and establish a fluid-tight seal therebetween to block inflow of fluid into the manhole through a space between the manhole and the manhole frame, wherein the establishing step further comprises the steps of placing an inside channel ring on the annular top face of the manhole adjacent to an interior side wall of the manhole, placing an outside channel ring on the annular top face of the manhole adjacent to the exterior side wall of the manhole, the inner diameter of the outside channel ring being greater than the inner diameter of the inside channel ring to establish the annular channel therebetween.

8. The method of claim 2, wherein the establishing step further includes the step of using an adhesive material to hold the inside and outside channel rings in place on the annular top face during the filling, putting, and curing steps.

9. The method of claim 7, wherein the establishing step further includes the step of preparing the annular top face of the manhole prior to the placing steps to promote bonding of the manhole to the liquid sealing material upon curing of the liquid sealing material.

10. The method of claim 9, wherein the preparing step includes the step of applying a primer to the annular top face.

11. The method of claim 9, wherein the preparing step includes the step of scaling the annular top face.

12. The method of claim 7, wherein the inside channel is made of structural foam.

13. The method of claim 7, wherein the outside channel ring is made of structural foam.

14. A method of bonding a manhole frame to a manhole to block inflow of fluid into the manhole through a space between the manhole frame and the manhole, the method comprising the steps of placing a separate mold on the manhole to establish a walled reservoir on the manhole, filling the walled reservoir with a liquid sealing material, contacting the manhole frame to liquid sealing material in the walled reservoir, and supporting the manhole frame on the mold as the liquid sealing material cures to establish a fluid-tight sealed bond between the manhole frame and the manhole.

15. The method of claim 14, wherein the placing step includes the steps of providing a mold and using an adhesive material to hold the mold in place on the manhole during the filling and contacting steps.

16. The method of claim 15, wherein the using step is completed prior to the filling step.

17. The method of claim 15, wherein the mold includes two separate mold members.

18. The method of claim 17, wherein each mold member is ring-shaped.

19. The method of claim 14, wherein each mold sealing material is one of a polyurethane encapsulate, epoxy, and fiberglass that is formulated to cure after a predetermined time to establish a water-tight pliable seal bonding the manhole frame to the manhole.

20. A method of bonding a manhole frame to a manhole to block inflow of fluid into the manhole through a space between the manhole frame and the manhole, the method comprising the steps of placing a mold on the manhole to establish a walled reservoir on the manhole, filling the walled reservoir with a liquid sealing material, contacting the manhole frame to liquid sealing material in the walled reservoir, and supporting the manhole frame on the mold as the liquid sealing material cures to establish a fluid-tight sealed bond between the manhole frame and the manhole, wherein the manhole includes an annular top face and the placing step includes the steps of providing an inside channel ring having a first inner diameter and an outside channel ring having a second inner diameter greater than the first inner diameter, positioning the inside channel ring on the annular top face of the manhole, and positioning the outside channel ring on the annular top face of the manhole around the inside channel ring and in spaced-apart relation to the inside channel ring to define the reservoir therebetween.

21. The method of claim 20, wherein the manhole includes a cylindrical interior wall contiguous to the annular top face, the inside channel ring includes a radially inner annular wall, and the inside channel ring is positioned on the annular top face in coaxial relation to the manhole to lie adjacent to the cylindrical interior wall.

22. The method of claim 20, wherein the manhole includes a cylindrical exterior wall contiguous to the annular top face, the outside channel ring includes a radially outer annular wall, and the outside channel ring is positioned on the annular top face in coaxial relation to the manhole to lie adjacent to the cylindrical exterior wall.

23. The method of claim 20, wherein the channel rings are made of dense material to provide means for supporting the manhole frame in contact with liquid sealing material in the reservoir and in spaced-apart relation to the underlying annular top face of the manhole.

24. The method of claim 23, wherein the dense material is structural foam.

25. A method of providing a sealed bond between a first manhole section having an annular top face and a second manhole section configured to mount on the annular top face, the method comprising the steps of establishing an annular channel on the annular top face of the first manhole section;

filling the annular channel with a liquid sealing material, then putting the second manhole section over the annular top face of the first manhole section in contact with the liquid sealing material in the channel, and curing the liquid sealing material to bond the first manhole section to the second manhole section and establish a fluid-tight seal therebetween to block inflow of fluid into the manhole through a space between the first and second manhole sections.

26. The method of claim 25, wherein the second manhole section includes an annular bottom face and further comprising the step of preparing the annular bottom face of the second manhole section prior to the putting step to promote bonding of the second manhole section to the liquid sealing material upon curing of the liquid sealing material.

27. The method of claim 26, wherein the preparing step includes the step of applying a primer to the bottom annular face.

28. The method of claim 26, wherein the preparing step includes the step of scaling the bottom annular face.

29. The method of claim 25, wherein the liquid sealing material is one of a polyurethane encapsulate, epoxy, and fiberglass that is formulated to cure after a predetermined period of time to establish a water-tight pliable seal bonding the first and second manhole sections.

30. A method of providing a sealed bond between a first manhole section having an annular top face and a second manhole section configured to mount on the annular top face, the method comprising the steps of establishing an annular channel on the annular top face of the first manhole section, filling the annular channel with a liquid sealing material, putting the second manhole section over the annular top face of the first manhole section in contact with the liquid sealing material in the channel, and curing the liquid sealing material to bond the first manhole section to the second manhole section and establish a fluid-tight seal therebetween to block inflow of fluid into the manhole through a space between the first and second manhole sections, wherein the establishing step further comprises the steps of placing an inside channel ring on the annular top face of the first manhole section adjacent to an interior side wall of the first manhole section, placing an outside channel ring on the annular top face of the first manhole section adjacent to the exterior side wall of the first manhole section, the inner diameter of the outside channel ring being greater than the inner diameter of the inside channel ring to establish the annular channel therebetween.

31. The method of claim 30, wherein the establishing step further includes the step of using an adhesive material to hold the inside and outside channel rings in place on the annular top face during the filling, putting, and curing steps.

32. The method of claim 30, wherein the establishing step further includes the step of preparing the annular top face of the first manhole section prior to the placing steps to promote bonding of the first manhole section to the liquid sealing material upon curing of the liquid sealing material.

33. The method of claim 32, wherein the preparing step includes the step of applying a primer to the annular top face.

34. The method of claim 32, wherein the preparing step includes the step of scaling the annular top face.

35. The method of claim 30, wherein the inside channel ring is made of structural foam.

36. The method of claim 30, wherein the outside channel ring is made of structural foam.

37. A method of bonding a first manhole section to a second manhole section to block inflow of fluid into the manhole sections through a space between the first and second manhole sections, the method comprising the steps of placing a separate mold on the first manhole section to establish a walled reservoir on the first manhole section, filling the walled reservoir with a liquid sealing material, contacting the second manhole section to liquid sealing material in the walled reservoir, and supporting the second manhole section on the mold as the liquid sealing material cures to establish a fluid-tight sealed bond between the first and second manhole sections.

38. The method of claim 37, wherein the placing step includes the steps of providing a mold and using an adhesive material to hold the mold in place on the first manhole section during the filling and contacting steps.

39. The method of claim 38, wherein the suing step is completed prior to the filling step.

40. The method of claim 38, wherein the mold includes two separate mold members.

41. The method of claim 40, wherein each mold member is ring-shaped.

42. The method of claim 37, wherein the liquid sealing material is one of a polyurethane encapsulate, epoxy, and fiberglass that is formulated to cure after a predetermined time to establish a water-tight pliable seal bonding the manhole frame to the manhole.

43. A method of bonding a first manhole section to a second manhole section to block inflow of fluid into the manhole sections through a space between the first and second manhole sections, the method comprising the steps of placing a mold on the first manhole section to establish a walled reservoir on the first manhole section, filling the walled reservoir with a liquid sealing material, contacting the second manhole section to liquid sealing material in the walled reservoir, and supporting the second manhole section on the mold as the liquid sealing material cures to establish a fluid-tight sealed bond between the first and second manhole sections, wherein the first manhole section includes an annular top face and the placing step includes the steps of providing an inside channel ring having a second inner diameter and an outside channel ring having a second inner diameter greater than the first inner diameter, positioning the inside channel ring on the annular top face of the first manhole section, and positioning the outside channel ring on the annular top face of the first manhole section around the inside channel ring and in spaced-apart relation to the inside channel ring to define the reservoir therebetween.

44. The method of claim 43, wherein the first manhole section includes a cylindrical interior wall contiguous to the annular top face, the inside channel ring includes a radially inner annular wall, and the inside channel ring is positioned on the annular top face in coaxial relation to the first manhole section to lie adjacent to the cylindrical interior wall.

45. The method of claim 43, wherein the first manhole section includes a cylindrical exterior wall contiguous to the annular top face, the outside channel ring includes a radially outer annular wall, and the outside channel ring is positioned on the annular top face in coaxial relation to the first manhole section to lie adjacent to the cylindrical exterior wall.

46. The method of claim 43, wherein the channel rings are made of dense material to provide means for supporting the second manhole section in contact with liquid sealing material in the reservoir and in spaced-apart relation to the underlying annular top face of the first manhole section.

47. The method of claim 46, wherein the dense material is structural foam.

48. A manhole seal molding kit having component parts capable of being assembled in the field at a manhole for providing a mold for containing a sealing and bonding material between a manhole having an annular top face and a manhole frame or section configured to mount on the annular top face, the kit comprising the combination of an inside channel ring having a first inner diameter and being configured to be mounted on the annular top face of the manhole adjacent to an interior side wall of the manhole, an outside channel ring having a second inner diameter and being configured to be mounted on the annular top face of the manhole adjacent to an exterior side wall of the manhole, the second inner diameter being greater than the first inner diameter so that the inside and outside channel rings are configured to be positioned in coaxial alignment and spaced-apart relation on the annular top face to form an annular channel thereon having a radially outer boundary established by the outside channel ring, a radially inner boundary established by the inside channel ring, and an annular bottom wall established by the annular top face of the manhole, whereby the inside and outside channel rings may be mounted on the manhole to provide a mold forming an annular channel configured to contain a curable sealing and bonding material in contact with the manhole and a manhole frame resting on the inside and outside channel rings as the sealing and bonding material cures.

49. The manhole seal molding kit of claim 48, wherein the inside channel ring is made of structural foam.

50. The manhole seal molding kit of claim 48, wherein the outside channel ring is made of structural foam.

51. The manhole seal molding kit of claim 48, wherein each of the inside and outside channel rings provides means for blocking radial flow of liquid sealing material deposited into the annular channel to retain the liquid sealing material in the annular channel while it cures.

52. The manhole seal molding kit of claim 48, wherein the channel rings are made of dense material to provide means for supporting the manhole frame in contact with sealing and bonding material contained in the annular channel and in spaced-apart relation to the underlying annular top face of the manhole.

53. The manhole seal molding kit of claim 52, wherein the dense material is structural foam.

* * * * *